US006523703B1

(12) United States Patent
Robertson

(10) Patent No.: US 6,523,703 B1
(45) Date of Patent: Feb. 25, 2003

(54) PUSHER MECHANISM FOR A MERCHANDISING DISPLAY SHELF

(75) Inventor: James D. Robertson, Atlanta, GA (US)

(73) Assignee: Display Industries, LLC., Smyrna, GA (US)

( * ) Notice: Subject to any disclaimer, the term of this patent is extended or adjusted under 35 U.S.C. 154(b) by 0 days.

(21) Appl. No.: 09/964,090

(22) Filed: Sep. 26, 2001

(51) Int. Cl.[7] ..... A47F 1/04
(52) U.S. Cl. ..... 211/59.3; 312/71; 211/51
(58) Field of Search ..... 211/59.3, 51; 312/71

(56) References Cited

U.S. PATENT DOCUMENTS

| | | | | | |
|---|---|---|---|---|---|
| 4,651,883 | A | | 3/1987 | Gullett et al. | 211/59.2 |
| 4,673,091 | A | * | 6/1987 | Robinson | 211/51 |
| 4,830,201 | A | * | 5/1989 | Breslow | 211/59.3 |
| 5,161,702 | A | * | 11/1992 | Skalski | 211/59.3 |
| 5,450,969 | A | | 9/1995 | Johnson et al. | 211/59.3 |
| 5,613,621 | A | * | 3/1997 | Gervasi | 221/279 |
| 5,634,564 | A | | 6/1997 | Spamer et al. | 211/59.3 |
| 5,992,653 | A | | 11/1999 | Anderson et al. | 211/59.3 |
| 6,015,051 | A | | 1/2000 | Battaglia | 211/59.3 |
| 6,082,558 | A | | 7/2000 | Battaglia | 211/59.3 |
| 6,129,218 | A | * | 10/2000 | Henry et al. | 211/59.3 |

* cited by examiner

*Primary Examiner*—Daniel P. Stodola
*Assistant Examiner*—Erica B. Harris
(74) *Attorney, Agent, or Firm*—John L. James

(57) ABSTRACT

A pusher apparatus pushes articles on a shelf in a display case forward when the front article is removed. The pusher apparatus has a partition panel dividing the shelf into first and second segments. The partition panel has front and rear end portions, first and second top rails, and first and second bottom rails. A first pusher panel has a top channel riding on the first top rail and a bottom channel riding on the first bottom rail, and a second pusher panel has a top channel riding on the second top rail and a bottom channel riding on the second bottom rail. A first coil spring has one end portion fastened to the front end portion of the partition panel and has the other end portion in contact with the first pusher panel. The first spring coils to move the first pusher panel from the rear end portion of the partition panel toward the front end portion of the partition panel. A second spring has one end portion fastened to the front end portion of the partition panel and has the other end portion in contact with the second pusher panel. The second spring coils to move the second pusher panel from the rear end portion of the partition panel toward the front end portion of the partition panel.

16 Claims, 5 Drawing Sheets

PUSHER MECHANISM FOR A MERCHANDISING DISPLAY SHELF

TECHNICAL FIELD OF THE INVENTION

This invention relates to a display device useful in merchandising articles, and, more particularly, to a shelf device having a pusher member for pushing articles forward on the shelf.

BACKGROUND OF THE INVENTION

Articles for sale are more appealing when they are displayed in a neat and orderly manner. Merchandising display shelves are used to help give order to articles for sale. Some articles can be arranged neatly in stacks on the shelves, while other articles can be arranged in orderly rows. Unfortunately shoppers have a tendency to topple neat stacks and dishevel orderly rows thereby requiring an attendant to restore order to the articles. Not only is this time consuming and expensive, it often places the attendant in a shopper's path making shopping less efficient. It is desirable to have a merchandising device that helps maintain the articles in an attractive arrangement.

In refrigerator and freezer units in supermarkets and other stores, articles, such as packages of frozen food for example, are often stacked on wire shelves. It does not take very long for the articles to become disheveled requiring a shopper to sift through numerous packages to find the desired package. Also, articles at the rear of the shelf are difficult to reach, and almost impossible to reach without incurring freezer bum or wet clothing as a result of the effort. There are track devices for dividing a wide shelf into narrower channels which help keeps articles in orderly rows. Many of these are bulky and unsuitable for use with frozen vegetables and other food articles. Also, many depend on gravity feed to advance articles forward for removal.

There are pusher devices that push articles on a shelf forward for easy removal, but many of these devices lack ventilation. To be useful in a refrigerated environment, there must be adequate ventilation. Also, some devices only push the articles without addressing dividing the articles into rows. Accordingly, it will be appreciated that it would be highly desirable to have a pusher device that divides the shelf into rows and pushes the articles forward while providing for ventilation.

SUMMARY OF THE INVENTION

The present invention is directed to overcoming one or more of the problems set forth above. According to one aspect of the invention, a pusher apparatus pushes articles on a shelf in a display case forward where the article is removed. The pusher apparatus has a partition panel for dividing the shelf into first and second segments. The partition panel has a front and rear end portions, first and second parallel top rails, and first and second parallel bottom rails. A first pusher panel has a top channel riding on the first top rail and a bottom channel riding on the first bottom rail, and a second pusher panel has a top channel riding on the second top rail and a bottom channel riding on the second bottom rail. A first coil spring has one end portion fastened to the front end portion of the partition panel and has the other end portion in contact with the first pusher panel. The first spring coils to move the first pusher panel from the rear end portion of the partition panel toward the front end portion of the partition panel. A second spring has one end portion fastened to the front end portion of the partition panel and having the other end portion in contact with the second pusher panel. The second spring coils to move the second pusher panel from the rear end portion of the partition panel toward the front end portion of the partition panel.

A hook, adapted to engage a slot in the shelf, extends downwardly from a bottom of the partition panel. When engaged, the hook prevents relative forward motion between the partition panel and shelf. A stop member is attached to the front end portion of the partition panel. The stop member abuts the shelf thereby preventing forward motion of the partition panel relative to the shelf.

An article is loaded on the shelf by pushing a pusher panel to the rear and inserting the articles in front of the pusher panel. As the pusher panel is pushed to the rear, the spring uncoils to apply a forward bias to the pusher panel. As an article is removed from the front of the shelf, the spring coils pushing the pusher panel and remaining articles forward.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
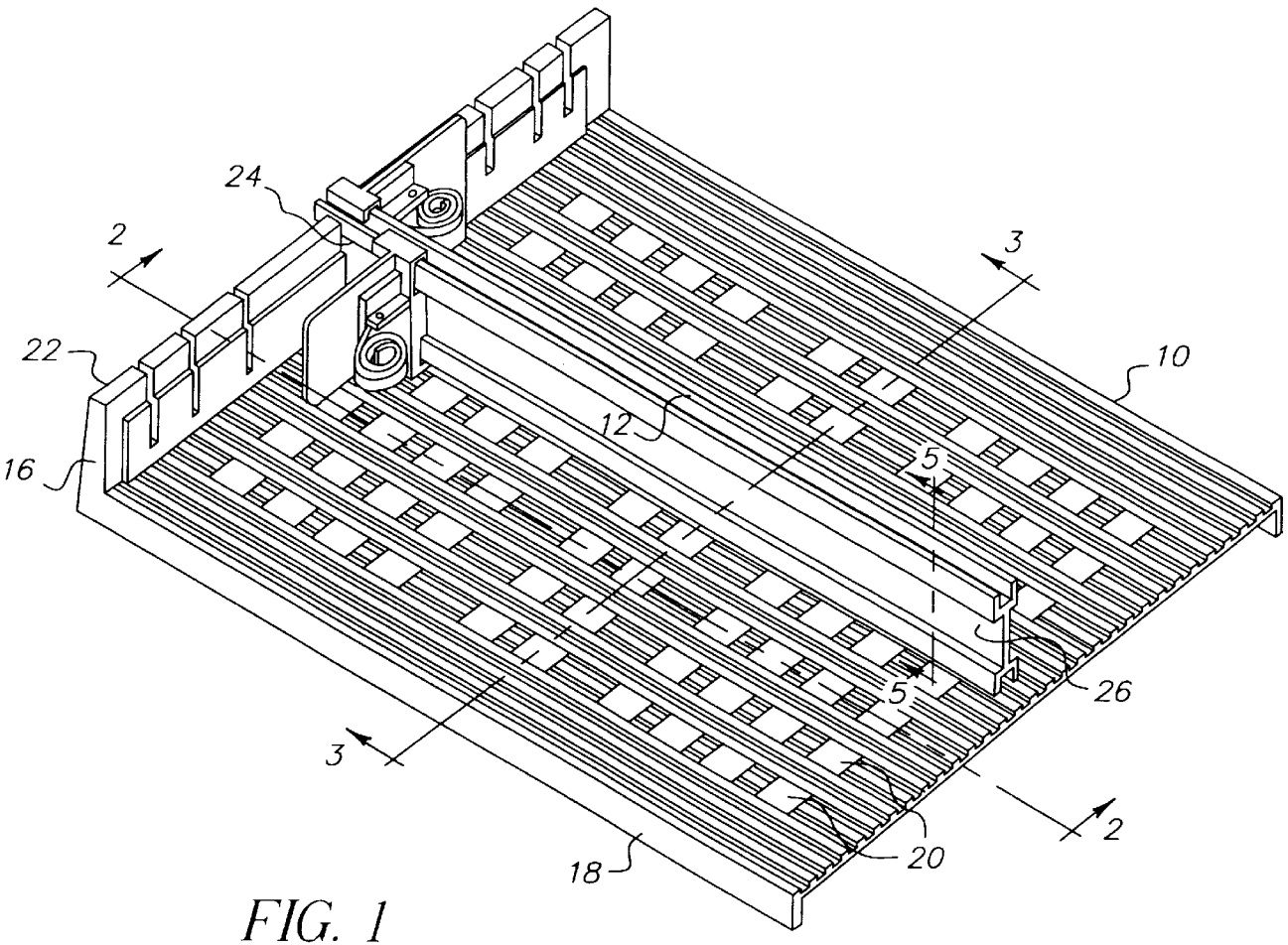
FIG. 1 is a perspective view of a preferred embodiment of a display shelf device incorporating a pusher mechanism according to the present invention.
Figure 2:
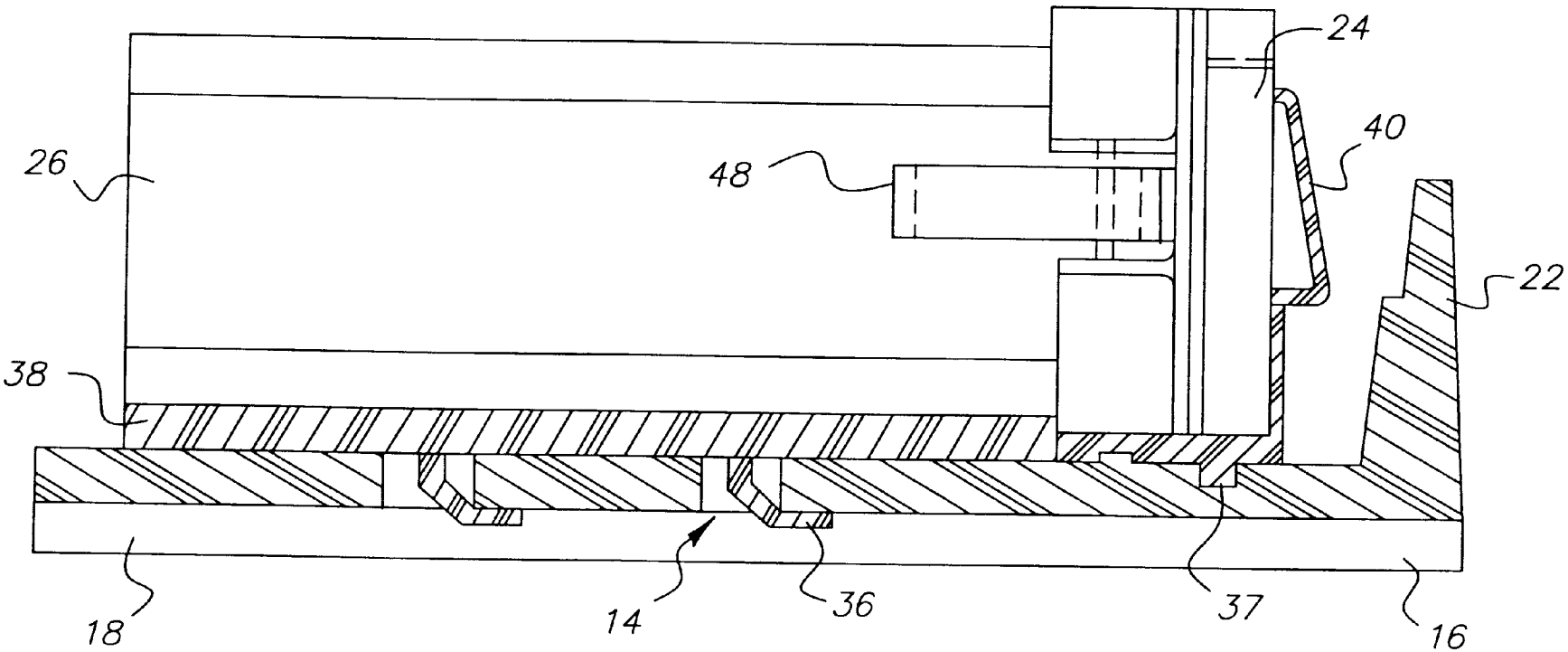
FIG. 2 is a sectional view taken along the line 2—2 of FIG. 1.
Figure 3:
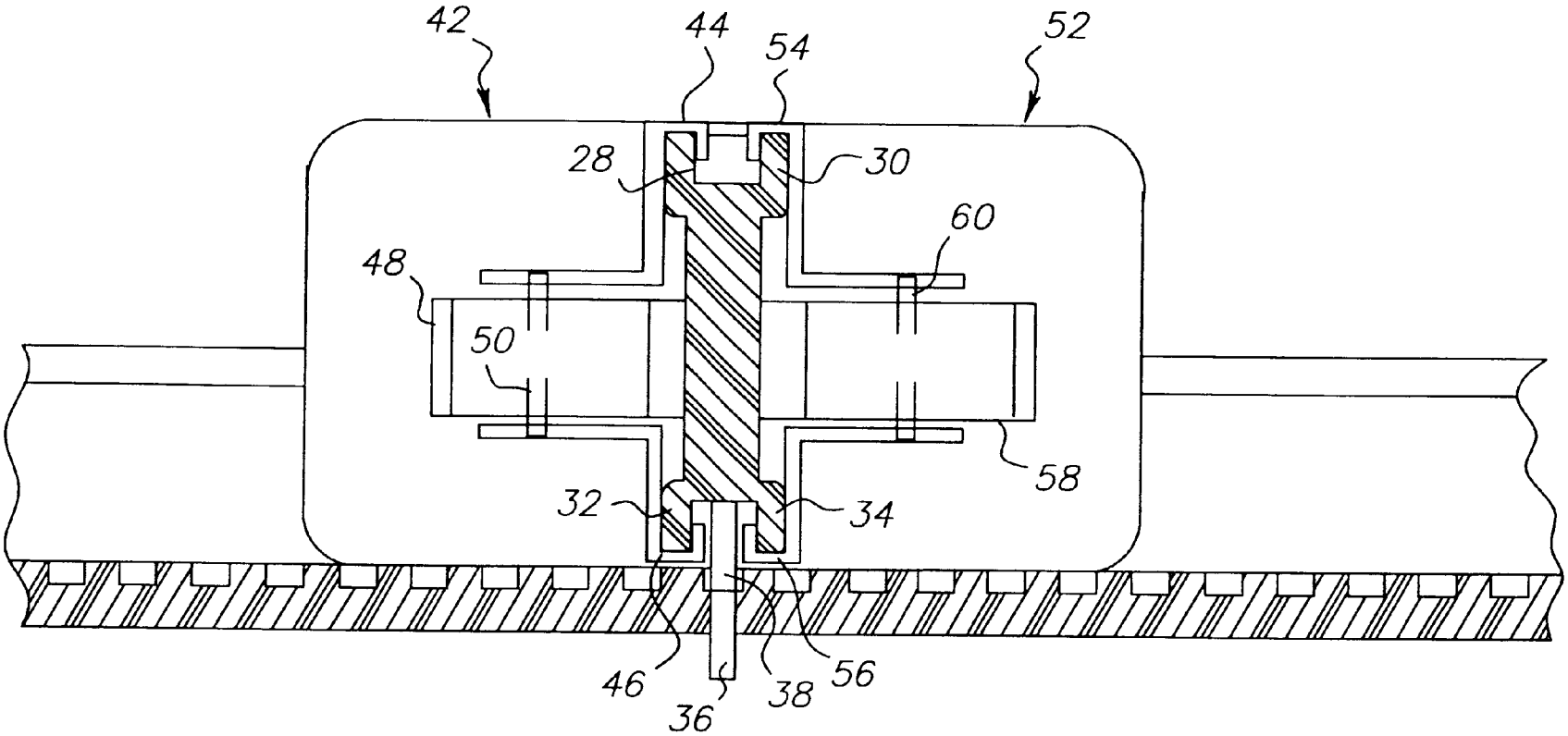
FIG. 3 is a sectional view taken along line 3—3 of FIG. 1.
Figure 4:
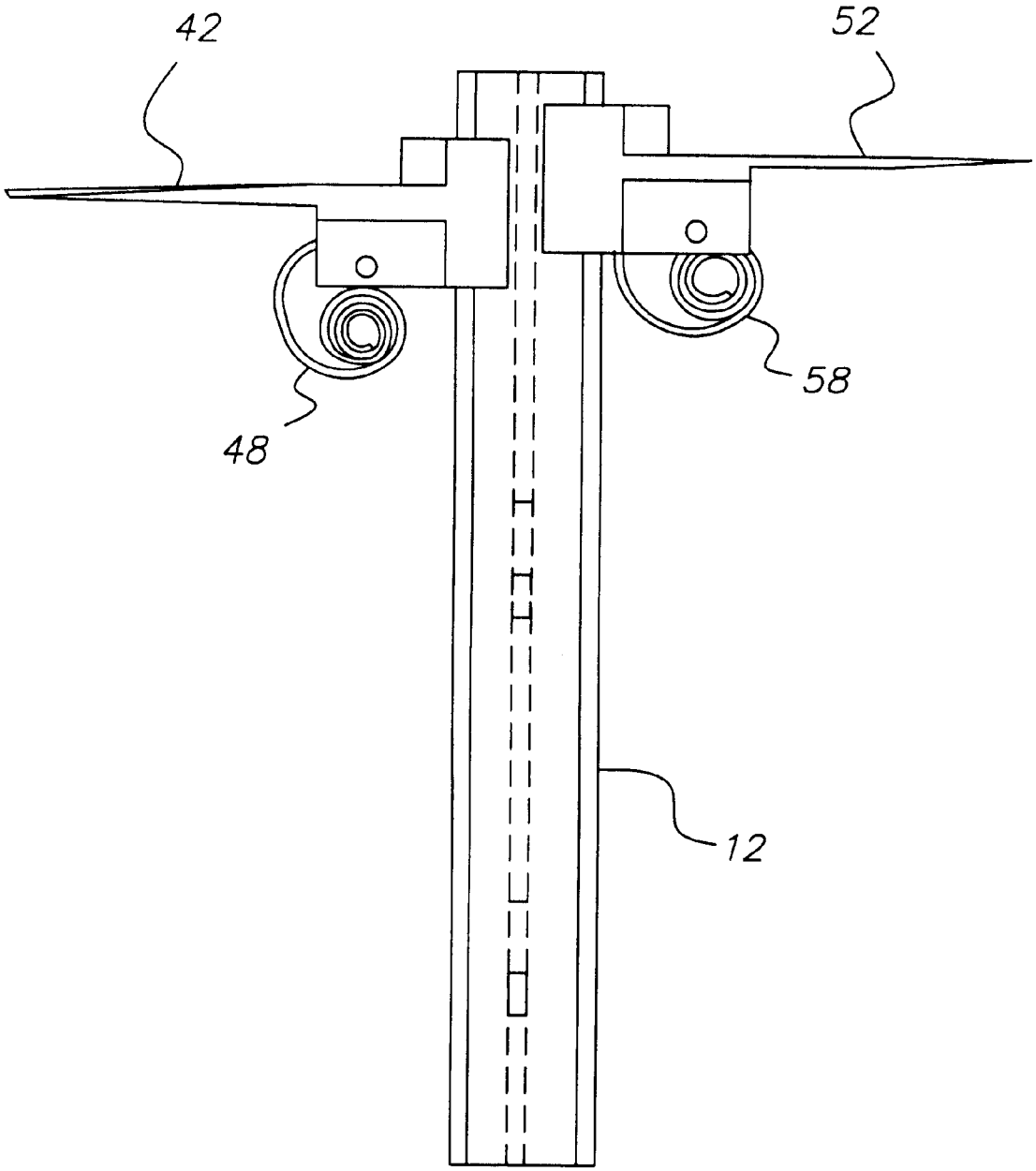
FIG. 4 is a top view of the pusher mechanism of FIGS. 1–3.
Figure 5:
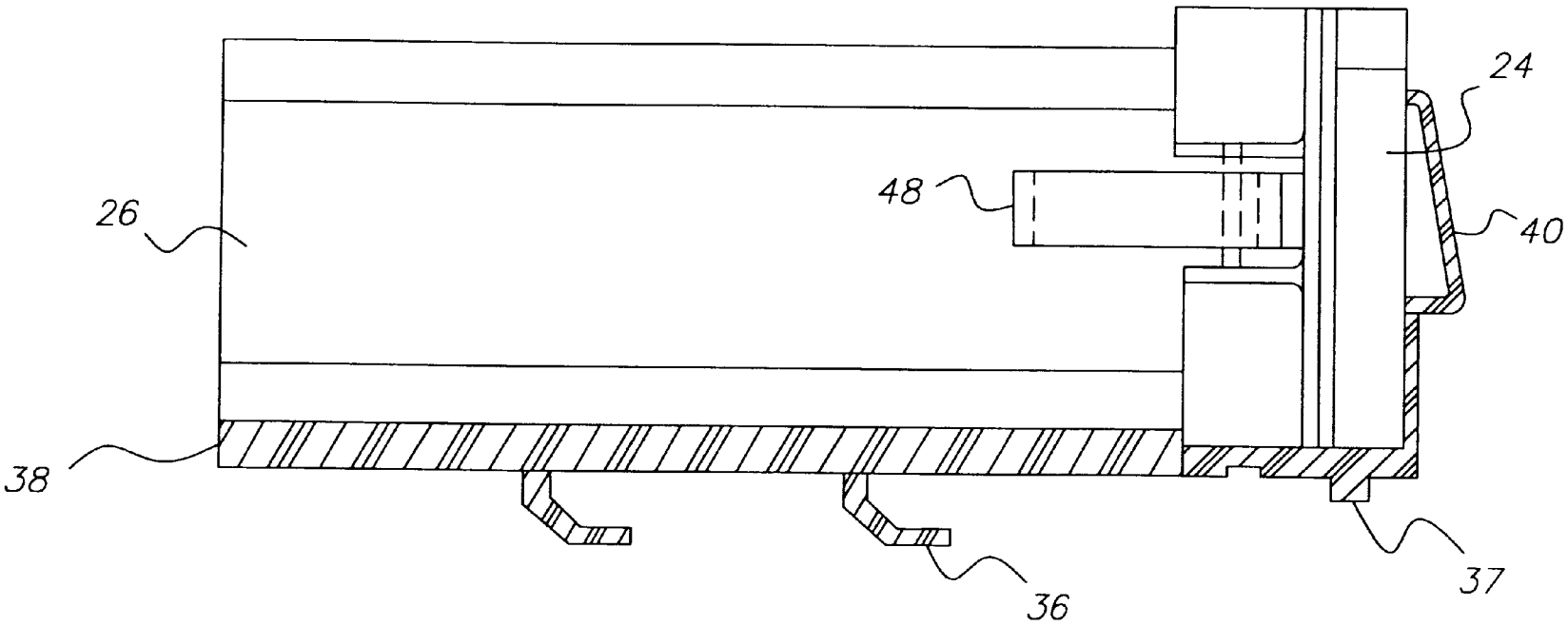
FIG. 5 is a side view of the pusher mechanism taken along line 5—5 of FIG.1.

Referring to FIGS. 1–5, a display shelf device has a shelf panel 10 and a partition panel 12 attached to the shelf panel by attaching means 14. Shelf panel 10 has a front end portion 16, a rear end portion 18 and a plurality of vent openings 20. Vent openings 20 are spaced over the shelf panel 10 for air circulation to maintain even temperature and humidity. A flange 22 is attached to the front end portion 16 of shelf panel 10 forming a front end wall for the shelf panel. Flange 22 can be perpendicular to the shelf but preferably forms an obtuse angle therewith with a top portion horizontally offset from a bottom portion forming a ledge or shoulder between the top and bottom portions. The partition panel 12 divides the shelf panel 10 into first and second segments and has front and rear end portions 24, 26. Partition panel 12 also has first and second parallel top rails 28, 30 and first and second parallel bottom rails 32, 34.

Partition panel 12 preferably has a general "I" cross-section with the first top rail 28 and first bottom rail 32 offset from the body of the "I" cross-sectioned partition panel 12 providing a space between the body and first top and first bottom rails 28, 32. Similarly, second top rail 30 and second bottom rail 34 are offset from the body of the partition panel 12 providing a space between the body of the partition panel 12 and the second top rail 30 and second bottom rail 34.

Attaching means 14 includes at least one hook 36 extending downwardly from a bottom portion of the partition panel 12 through a slot in the shelf panel 10. Hook 36 is a protruding piece of material attached to the bottom portion of partition panel 12. It extends toward front end portion 24 with a distal portion spaced from the bottom portion of panel 12 creating a space between the distal portion and bottom portion slightly larger than the thickness of shelf panel 10 in the vicinity of the slot through which hook 36 extends. Hook 36 has a general "J" configuration with the long back of the "J" parallel to the bottom of partition panel 12 forming a general, sideways therewith. The open mouth of the sideways "U" receives the shelf panel while the bottom of the "U" limits forward movement of partition panel 12 relative to shelf panel 10. As illustrated, there are two hooks, each extending through a slot.

In addition, front end portion 24 contains a downwardly extending protrusion 37 that engages a slot in the shelf panel 10 to help position and anchor partition panel 12. Protrusion 37 does not extend downwardly as far as hook 36 and need not protrude all the way through the shelf panel. Attaching means 14 preferably includes a third bottom rail 38 positioned between and parallel to the first and second bottom rails 32, 34. The third bottom rail 38 extends downwardly a greater distance than the first and second bottom rails. The hook 36 extends downwardly from the third bottom rail and through the slot in the shelf panel.

A stop member 40 is attached to the front end portion 24 of the partition panel 12. The stop member 40 abuts the shelf panel 10 thereby preventing forward motion of the partition panel 12 relative to the shelf panel 10. Stop member 40 preferably has a top portion horizontally offset from a bottom portion forming a ledge or shoulder that rests on the ledge of flange 22.

A first pusher panel 42 has a top channel member 44 riding on the first top rail 28 and a bottom channel member 46 riding on the first bottom rail 32. Channel member 44 has a laterally extending flange with an opening. Channel member 46 also has a laterally extending flange with an opening that aligns vertically with the opening in the flange of channel member 44. Because pusher panel 42 is attached to partition panel 12 at the top and bottom by channel members riding on rails, panel 42 moves linearly without skewing. Linear movement is important because linear motion causes articles to move forward on the shelf while maintaining a desired orientation. With favorable orientation articles are easier to remove and article labels are easier to read.

A first coil spring 48 has one end portion fastened to the front end portion of the partition panel 12 preferably with a bolt that extends through an opening in the front end portion of the partition panel. The other end portion of spring 48 is in contact with the first pusher panel 42 and attached thereto by a pin 50 fitted through the openings in the flanges of the channel members 44, 46. The first coil spring 48 coils to move the first pusher panel 42 from the rear end portion of the partition panel 12 toward the front end portion of the partition panel which moves articles from the rear of the shelf to the front for easy removal.

A second pusher panel 52 has a top channel member 54 riding on the second top rail 30 and a bottom channel member 56 riding on the second bottom rail 32. Channel member 54 has a laterally extending flange with an opening. Channel member 56 also has a laterally extending flange with an opening that aligns vertically with the opening in the flange of channel member 54.

A second coil spring 58 has one end portion fastened to the front end portion of the partition panel 12 preferably with a bolt that extends through an opening in the front end portion of the partition panel. A single bolt is sufficient to anchor the front end of both coil springs. The other end portion of coil spring 58 is in contact with the first pusher panel 52 and attached thereto by a pin 60 fitted through the openings in the flanges of the channel members 54, 56. The second coil spring 58 coils to move the second pusher panel 52 from the rear end portion of the partition panel 12 toward the front end portion of the partition panel which moves articles from the rear of the shelf to the front for easy removal.

The general "I" cross-section of the partition panel with the first top rail and the first bottom rail offset from the body of the partition panel provide a space for the first coil spring 48 between the partition panel 12 and the first pusher panel 42. Similarly, the second top rail and the second bottom rail are offset from the main body of the partition panel 12 providing a space for the second coil spring 58 between the partition panel 12 and the second pusher panel 52. Each spring is preferably a two-stage structure comprising inner layers of spring strip disposed in substantial contact with each other and outer layers of spring strip substantially spaced from each other radially of the coil axis. The coil arrangement permits the portion composed of outer layers to behave as a graduate/variable force spring and yet the portion composed of the inner layers to behave as a constant force spring. Such a spring is more fully described in U.S. Pat. No. 5,634,564, the disclosure of which is incorporated herein by reference.

The shelf and partition panels are preferably constructed of plastic while the coil springs are metal. The holding pins 50, 60 are also preferably metal but plastic or ceramic pins may be used. Also, shelf panel 10 preferably has a low friction surface which permits articles to slide easily thereon.

Articles may be loaded from the front or the rear of the shelf. When loading from the front, a pusher panel is pushed toward the rear with a hand or the article to be loaded. As the pusher panel moves rearward, it uncoils creating a force that urges the pusher panel toward the front. When an article is removed, the spring coils to urge the pusher panel and remaining articles forward.

When loading from the rear, a hand is used to pull the pusher panel toward the rear while an article is inserted. As the pusher panel moves rearward, it uncoils creating the force that urges the pusher panel toward the front of the shelf. Although both pusher assemblies are attached to a single partition panel, each pusher acts independently of the other.

It can now be appreciated that a pusher mechanism for a merchandising display shelf has been presented. When used in a refrigerated environment, the shelf has a plurality of ventilation openings distributed over its surface area. Ventilation openings are optional in non-refrigerated environments but may be used for humidity control or aroma control. The pusher mechanism divides the shelf into rows wherein each pusher plate pushes articles forward for easy access.

While the invention has been described with particular reference to the preferred embodiments, it will be understood by those skilled in the art that various changes may be made and equivalents may be substituted for elements of the preferred embodiments without departing from invention. For example, while plastic is preferred for the shelf panel and pusher panel, the panels could be formed of metal. It is accordingly intended that the claims shall cover all such modifications and applications as do not depart from the true spirit and scope of the invention.

What is claimed is:

1. A pusher apparatus for a shelf having slots, comprising:

a partition panel for dividing the shelf into first and second segments, said partition panel having a front end portion and a rear end portion, said partition panel having first and second parallel top rails and first and second parallel bottom rails, wherein each of said first and second parallel top rails has a top engagement surface;

attaching means for attaching said partition panel to the shelf;

a first pusher panel having a top channel riding on said top engagement surface of said first top rail and a bottom channel riding on said first bottom rail;

a first coil spring having one end portion fastened to said front end portion of said partition panel and having the other end portion in contact with said first pusher panel, said first coil spring coiling to move said first pusher panel from said rear end portion of said partition panel toward said front end portion of said partition panel;

a second pusher panel having a top channel riding on said top engagement surface of said second top rail and a bottom channel riding on said second bottom rail; and a second coil spring having one end portion fastened to said front end portion of said partition panel and having the other end portion in contact with said second pusher panel, said second coil spring coiling to move said second pusher panel from said rear end portion of said partition panel toward said front end portion of said partition panel.

2. A pusher apparatus, as set forth in claim 1, including a single fastener connecting said first and second coil springs to said partition panel.

3. A pusher apparatus, as set forth in claim 1, wherein said partition panel has a general "I" cross-section with said first top rail and said first bottom rail offset from the body of said partition panel providing a space for said first coil spring between said partition panel and said first pusher panel.

4. A pusher apparatus, as set forth in claim 3, wherein said second top rail and said second bottom rail are offset from the main body of said partition panel thereby providing a space for said second coil spring between said partition panel and said second pusher panel.

5. A pusher apparatus, as set forth in claim 1, wherein said attaching means includes at least one hook extending downwardly from a bottom of said partition panel, said hook being adapted to engage one of the slots in the shelf.

6. A pusher apparatus, as set forth in claim 1, wherein said attaching means includes a third bottom rail positioned between and parallel to said first and second bottom rails, said third bottom rail extending downwardly a greater distance than said first and second bottom rails.

7. A display channel, as set forth in claim 6, including at least one hook extending downwardly from said third bottom rail, said hook being adapted to engage one of the slots in the shelf.

8. A pusher apparatus, as set forth in claim 1, wherein said attaching means includes a stop member attached to said front end portion of said partition panel, said stop member adapted to abut the shelf thereby preventing forward motion of said partition panel relative to the shelf.

9. An apparatus, comprising:

a shelf panel having a front end portion, a rear end portion, at least one slot, a plurality of vent openings and a flange attached to said front end portion;

a partition panel for dividing said shelf panel into first and second segments, said partition panel having a front end portion and a rear end portion, said partition panel having first and second parallel top rails and first and second parallel bottom rails, wherein each of said first and second parallel top rails has a top engagement surface;

attaching means for attaching said partition panel to said shelf;

a first pusher panel having a top channel riding on said top engagement surface of said first top rail and a bottom channel riding on said first bottom rail;

a first coil spring having one end portion fastened to said front end portion of said partition panel and having the other end portion in contact with said first pusher panel, said first coil spring coiling to move said first pusher panel from said rear end portion of said partition panel toward said front end portion of said partition panel;

a second pusher panel having a top channel riding on said top engagement surface of said second top rail and a bottom channel riding on said second bottom rail; and a second coil spring having one end portion fastened to said front end portion of said partition panel and having the other end portion in contact with said second pusher panel, said second coil spring coiling to move said second pusher panel from said rear end portion of said partition panel toward said front end portion of said partition panel.

10. A pusher apparatus, as set forth in claim 9, including a single fastener connecting said first and second coil springs to said partition panel.

11. A pusher apparatus, as set forth in claim 9, wherein said partition panel has a general "I" cross-section with said first top rail and said first bottom rail offset from the body of said partition panel providing a space for said first coil spring between said partition panel and said first pusher panel.

12. A pusher apparatus, as set forth in claim 11, wherein said second top rail and said second bottom rail are offset from the main body of said partition panel thereby providing a space for said second coil spring between said partition panel and said second pusher panel.

13. A pusher apparatus, as set forth in claim 9, wherein said attaching means includes at least one hook extending downwardly from a bottom of said partition panel through said slot in said shelf panel.

14. A pusher apparatus, as set forth in claim 9, wherein said attaching means includes a third bottom rail positioned between and parallel to said first and second bottom rails, said third bottom rail extending downwardly a greater distance than said first and second bottom rails.

15. A display channel, as set forth in claim 14, including at least one hook extending downwardly extending from said third bottom rail through said slot in said shelf panel.

16. A pusher apparatus, as set forth in claim 9, wherein said attaching means includes a stop member attached to said front end portion of said partition panel, said stop member abutting said flange thereby preventing forward motion of said partition panel relative to the shelf panel.

* * * * *